US006126495A

United States Patent [19]

Lolic et al.

[11] Patent Number: 6,126,495

[45] Date of Patent: Oct. 3, 2000

[54] MINIATURIZED PLUG-IN CONTACT ELEMENT

[75] Inventors: Srboslav Lolic, Wuppertal; Bernd Zinn, Ennepetal; Werner Moritz, Wuppertal, all of Germany

[73] Assignee: Grote & Hartmann GmbH & Co. KG, Wuppertal, Germany

[21] Appl. No.: 09/178,459

[22] Filed: Oct. 23, 1998

[30] Foreign Application Priority Data

Oct. 28, 1997 [DE] Germany ..... 297 19 153 U

[51] Int. Cl.[7] ..... H01R 4/48; H01R 13/40

[52] U.S. Cl. ..... 439/839; 439/752.5

[58] Field of Search ..... 439/839, 819, 439/833, 843, 845, 752.5

[56] References Cited

U.S. PATENT DOCUMENTS

| | | | |
|---|---|---|---|
| 3,836,947 | 9/1974 | Yaeger | 339/259 R |
| 4,932,877 | 6/1990 | Zinn | 439/839 |
| 5,007,865 | 4/1991 | Jakobelt | 439/839 |
| 5,094,636 | 3/1992 | Zinn | 439/839 |
| 5,188,545 | 2/1993 | Hass et al. | 439/851 |
| 5,573,434 | 11/1996 | Ittah et al. | 439/839 |
| 5,664,972 | 9/1997 | Zinn | 439/839 |
| 5,683,274 | 11/1997 | Straeb et al. | 439/839 |
| 5,938,485 | 8/1999 | Hotea et al. | 439/829 |

FOREIGN PATENT DOCUMENTS

| | | | |
|---|---|---|---|
| 0352871 | 5/1990 | Germany | H01R 13/18 |

*Primary Examiner*—Lincoln Donovan
*Assistant Examiner*—Chandrika Prasad
*Attorney, Agent, or Firm*—Goodman & Teitelbaum Eaqs.

[57] ABSTRACT

A plug-in contact element, which is fabricated from a sheet metal stamping for receiving a post-like plug-in contact pin having four sides has a basic contact member provided with a rear connecting region, a central base region and a front contact region linked together one behind another in a one piece construction along a longitudinal axis, the central base region having a box shaped configuration, and the front contact region including contact spring arms for contacting the sides of the plug-in contact pin. A rectangular sleeve is arranged around the central base region and the front contact region so that the contact spring arms are protectively disposed within the rectangualr sleeve. A polarization plate and a latching spring arm project outwardly from a sleeve top wall of the rectangular sleeve. A box cantilever spring is provided with first and second cantilever spring arms disposed in loading contact with outer surfaces of the contact spring arms to provide a contact force between the contact spring arms and the plug-in contact pin.

30 Claims, 7 Drawing Sheets

A - A

B - B

C - C

D - D

H - H

MINIATURIZED PLUG-IN CONTACT ELEMENT

Figure 1:
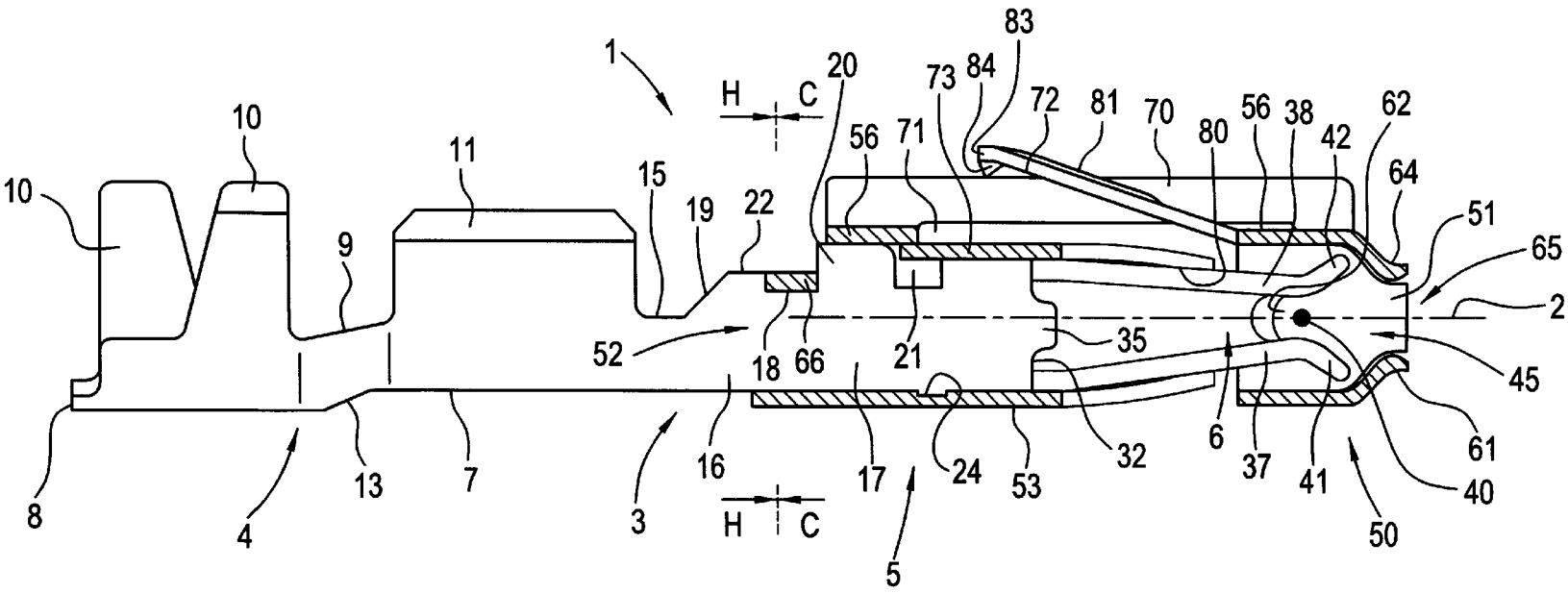

The invention relates to a miniaturized plug-in contact element.

Plug-in contact elements of this type are normally arranged in plug-in connector housings in a predefined plug-in pattern and, in order to produce an electrical connection, each accommodate a post-like plug-in contact pin having a square or round cross section.

A plug-in contact element is disclosed by DE 88 15 178 U1.

This plug-in contact element has, arranged one behind another along a longitudinal axis, a rear conductor-wire connecting region, a central spring arm base region and a front spring arm region. The connecting region comprises conductor-wire and insulation claws.

The connecting region merges into a rectangular tube-shaped contact spring arm base region. The rectangular tube-shaped contact spring arm base region has an essentially square cross section with a bottom wall, two side walls and a top wall. In each case from one pair of mutually adjacent front edges of two walls of the rectangular tube-shaped base, a pair of elongate contact springs extends to the front and forms the spring arm region. The two contact spring arms consequently have an L-shaped cross section. The contact spring arms run between the base and a free end, opposite the base, of the contact spring arms, essentially parallel to each other, so that the overall square cross section of the contact spring arm base is continued toward the front. In the region of the free ends of the contact spring arms, an elevation curved in toward the longitudinal axis of the contact element is formed in each L-shaped limb in the manner of an impression. Each elevation forms a uniformly curved contact surface which has the shape of a spherical segment or spherical section. Between the contact elevations and the contact spring arm base, each contact spring has a longitudinal slot along the edge bent in an L shape, by which it is divided in the region of the slot. The L-shaped limbs of each contact spring are thus connected to each other by a spring-arm linking tab in the region of the contact elevations as far as the free end of the contact spring arms and also at the contact spring arm base.

The plug-in contact element is provided with a protective sleeve, which is intended to counteract overstressing or overstretching of the contact springs, should the plug-in contact element be connected to an oversized pin or should a pin be plugged into the plug-in contact element with a misalignment. This protective sleeve is of square tubular design having an essentially square cross section and has a bottom wall, two side walls and a top wall. Cut free from the top wall is a locking tongue, whose free end is bent out in order to engage on a shoulder in a cavity in a plug-in contact housing. One of the side walls is extended beyond the top wall, by which means an encoding plate is formed, which is intended to ensure a desired orientation when being plugged into a plug-in contact housing. At its front end, the protective sleeve has four retaining flanges, which extend obliquely in relation to the interior of the protective sleeve and to the longitudinal axis of the plug-in contact element. Arranged at the rear end of the protective sleeve are firm-clamping tongues. For the purpose of assembly, the protective sleeve is pushed with its rear end over the contact spring arms, in the direction of the spring arm base. In the assembled state, the protective sleeve stretches from the spring arm base beyond the free end of the contact spring arms.

In the case of a plug-in contact element of this type, it is disadvantageous that this requires a great deal of space and, in addition, is very complicated to produce. In the case of plug-in contact elements of this type, the contact spring arms only rest partly on all four side faces of a plug-in contact pin.

The lack of contact is further reinforced by the fact that, as a result of the L-shaped design of the contact spring arms in their end region, when a contact pin is being plugged in, the contact spring arms do not deflect at right angles to the contact face of the pin, but have to execute a diagonal lateral deflection movement. As a result of this space requirement, taken up in particular by the side regions, it is not possible with plug-in contact elements of this type to ensure this close plug-in pattern and optimum contact-making.

Furthermore, EP 0 352 871 B1 discloses a box spring. In the case of this box spring, a flat fork spring is combined with a cantilever spring, both being present in miniaturized form. The flat fork spring is designed as a twin-armed flat fork spring, the spring arms of the flat fork spring and the cantilever spring arms being arranged in the east/west direction, and a latching spring arm being arranged in the north or south direction. In the case of this known box spring, the spring arm base is of U-shaped design.

The plug-in contact pins, which are normally used to make contact with such a plug-in contact element, are in most cases, for production reasons, coated with noble metal of a defined layer thickness only on two opposite sides, specifically in the north/south direction. The sides of a plug-in contact element or of a plug-in contact pin may be defined in a plug-in side plan view in a manner analogous to a compass rose, the bottom wall of the connecting region of the plug-in contact element or of the plug-in contact pin defining the south side, and the side toward which the crimp tabs point, or the upwardly open side, being referred to as the north side. Consequently, the side walls form the east and west sides.

In particular as a result of resting on a side wall (east or west) of the pin, which wall is not or not specifically coated, the current transfer is not optimal.

In addition, the contact spring forces are not optimal.

DE 195 36 264 A1 discloses a contact spring with a latching sleeve, in which, in order to fasten a latching sleeve, serving as a cantilever spring, to a basic spring, the latching sleeve is provided with two lateral holding spigots formed by severing cuts, which engage in a cut-out in the spring-limb base of the basic spring and around which side walls are bent inward. This known contact spring has contact spring arms, which are arranged on top and bottom walls (north/south), these contact spring arms being loaded by cantilever arms of the latching sleeve, which are likewise arranged in the north/south direction. The cantilever spring arms are cut free of the top and bottom wall of the latching sleeve by parabolic cuts, such that they extend from one longitudinal edge in the direction of an opposite longitudinal edge, being bent inward in order to rest on the contact spring arms. Furthermore, a latching spring arm that points upward and rearward is cut free of the top wall and bent outward. In the case of this known plug-in contact element, it is disadvantageous that, because of the configuration of the cantilever spring arms, in particular because of the short effective spring travel and the sharp bending into the sleeve resulting from this, an unfavorable spring characteristic results. Furthermore, when the spring arms are being widened, the cantilever spring arms slide over their outer surface, transversely to the longitudinal direction, as a result of which the contact spring forces are not constant over the width of the contact spring. As a result of arranging the latching spring arm adjacent to one of the cantilever spring arms, the latter is very short, so that it cannot be arranged to project very far to the outside. The directly adjacent arrangement of a cantilever spring arm and of a latching spring arm on a single wall of a contact spring element also leads to instability in the cantilever spring sleeve.

The object of the invention is to provide a miniaturized plug-in contact element having two contact spring arms made of a sheet-metal stamping, which requires a small amount of space, in particular a smaller lateral space, so that, given predefined small plug-in patterns, there is no need for space, and which is more simply constructed and simpler to produce and, in particular, also permits the making of a better contact by making contact in the north/south direction, as well as optimized contact spring forces, together with optimized current transfer.

This object is achieved by a miniaturized plug-in contact element having the features set forth below. Advantageous developments are also identified below.

According to the invention, the miniaturized plug-in contact element has contact spring arms located only opposite the sides, of a contact pin to be plugged in. It is possible for these contact spring arms to rest with their contact or spring fork arms on the entire width of the respective north or south side of a plug-in contact pin. In order to achieve a still further improved, optimized contact force, the contact spring arms are additionally loaded with cantilever spring arms, the cantilever spring arms likewise being arranged in the north/south direction. Arranged above one of these cantilever spring arms, likewise in the north or south direction, is a latching spring arm, so that as a result of dispensing, according to the invention, with outwardly projecting components on the side walls, a particularly narrow and space-saving design of a plug-in contact element is achieved.

Figure 2:
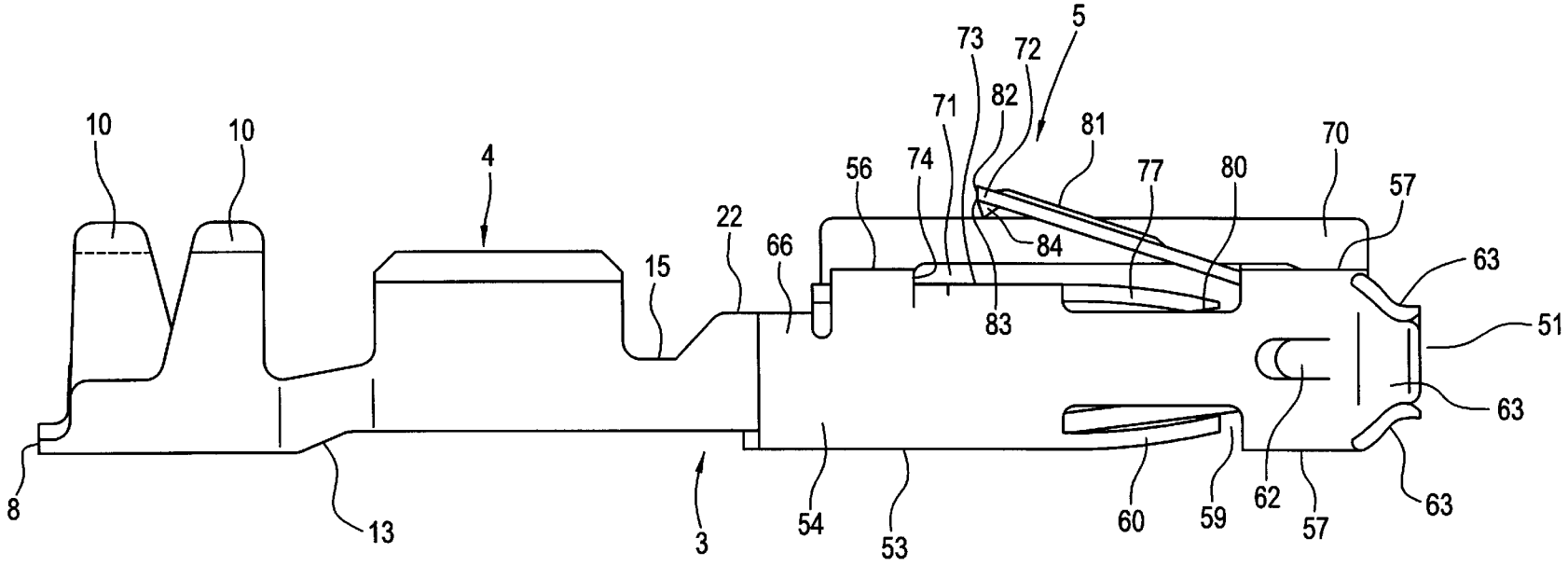
Figure 3:
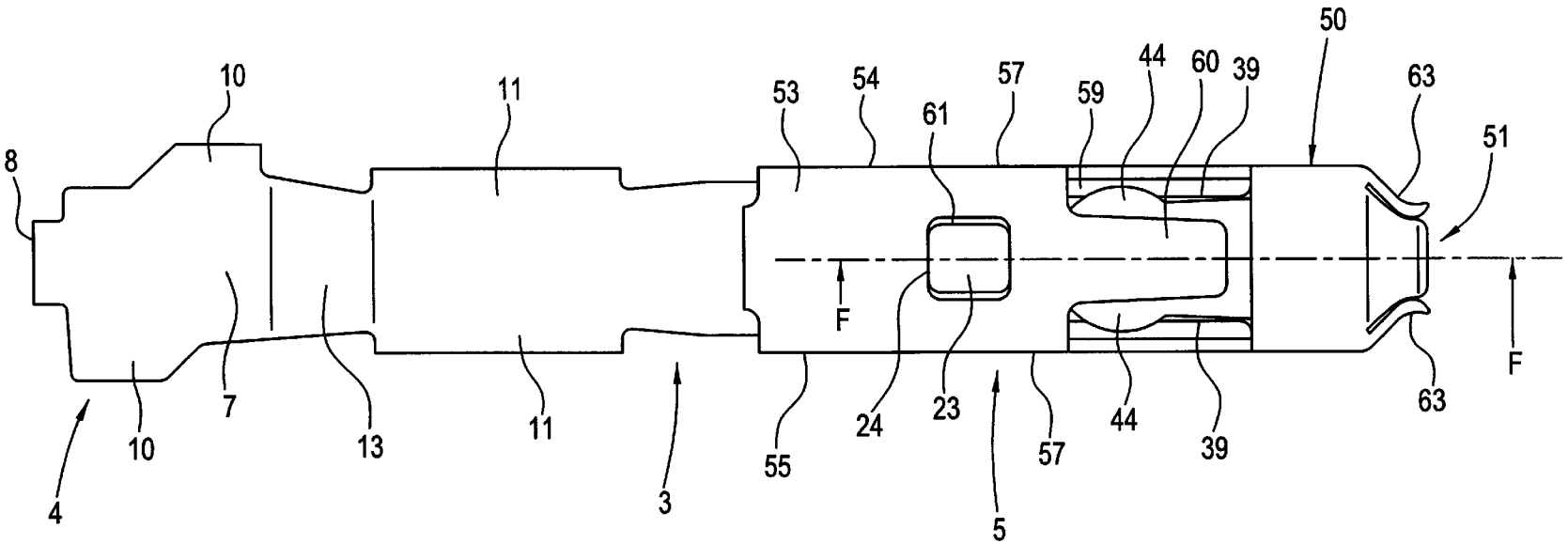
Figure 4:
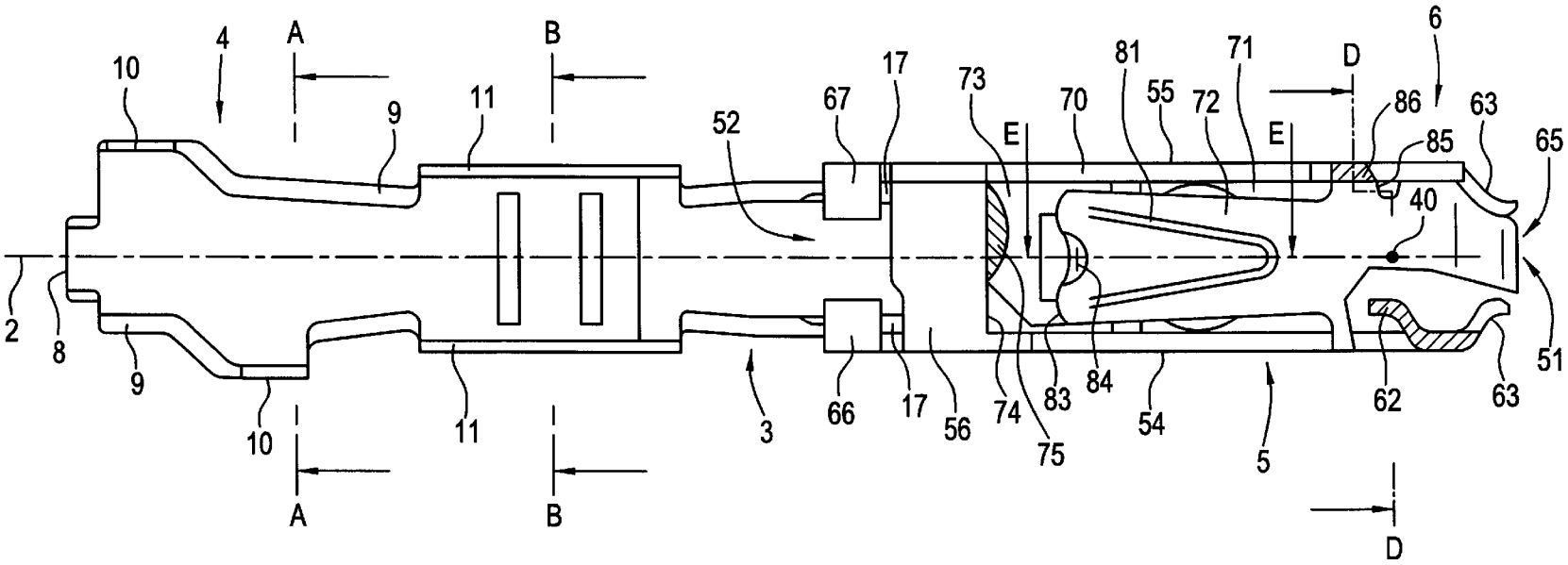
Figure 5:
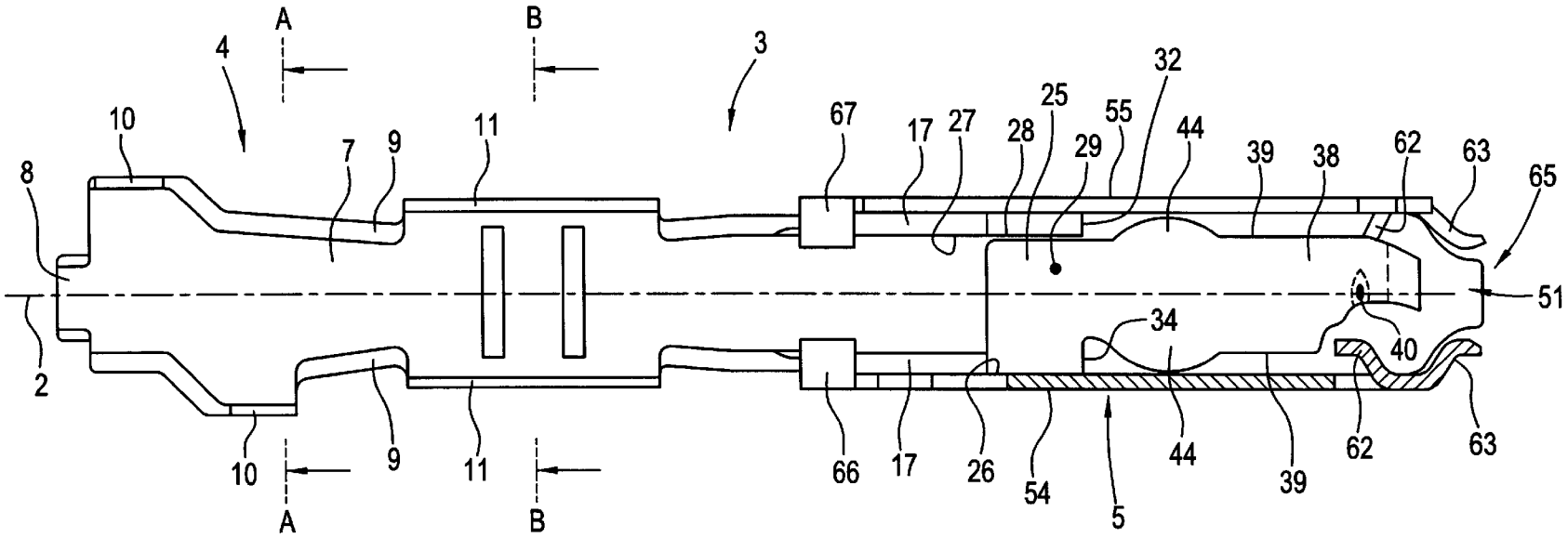
Figure 6:
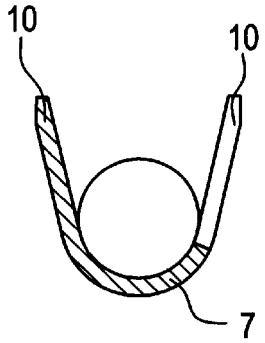
Figure 7:
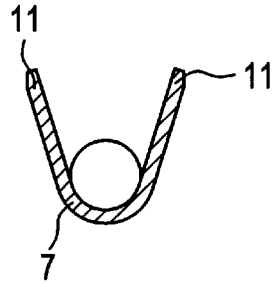
Figure 8:
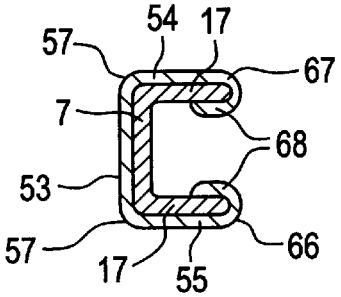
Figure 9:
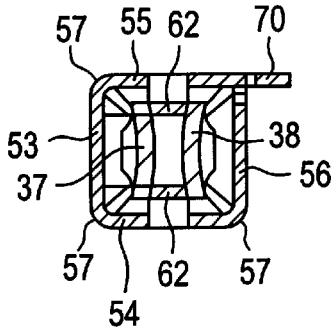
Figure 10:
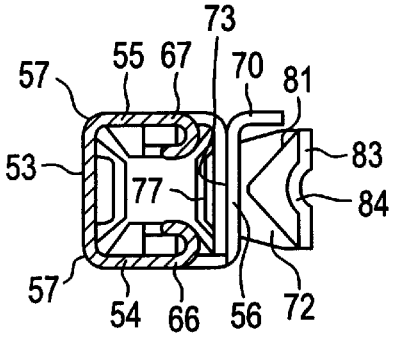
Figure 11:
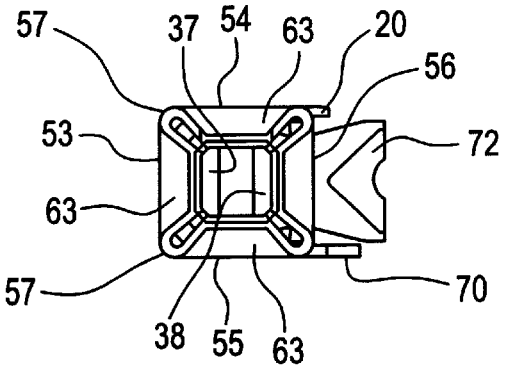
Figure 12:
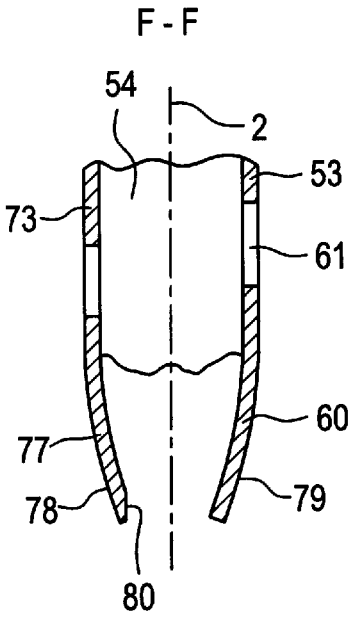
Figure 13:
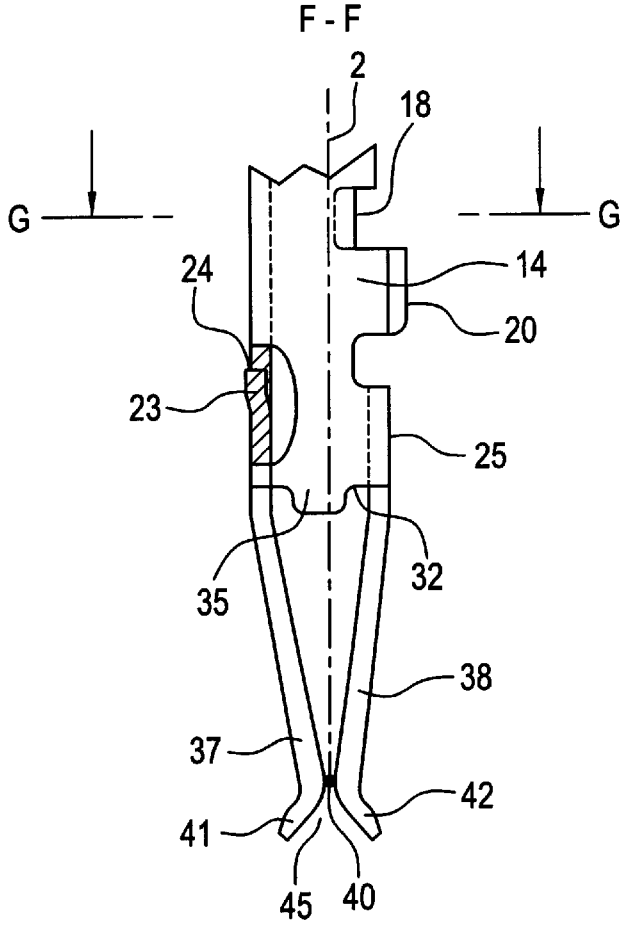
Figure 14:
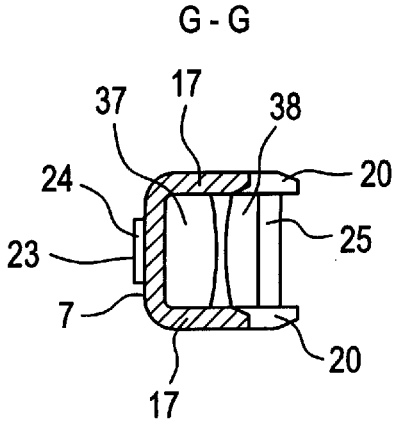

The invention will be explained below with reference to a drawing, in which:

FIG. 1 shows a partly sectioned side view of an inventive plug-in contact element, FIG. 2 shows an inventive plug-in contact element according to FIG. 1 in a side view, FIG. 3 shows an inventive plug-in contact element from below, FIG. 4 shows an inventive plug-in contact element from above in a partly sectioned view, FIG. 5 shows an inventive plug-in contact element from above in a sectioned view, FIG. 6 shows an inventive plug-in contact element in a cross-sectional illustration along the line A—A according to FIG. 4, FIG. 7 shows an inventive plug-in contact element in a cross-sectional illustration along the line B—B according to FIG. 4, FIG. 8 shows an inventive plug-in contact element in a cross-sectional illustration along the line C—C according to FIG. 1, FIG. 9 shows an inventive plug-in contact element in a cross-sectional illustration along the line D—D according to FIG. 4, FIG. 10 shows an inventive plug-in contact element in a cross-sectional illustration along the line H—H according to FIG. 1, FIG. 11 shows an inventive plug-in contact element in a view from the front, FIG. 12 shows an inventive cantilever spring sleeve of an inventive plug-in contact element in a sectioned view along the line F—F according to FIG. 3, FIG. 13 shows spring arms and spring arm base region of an inventive plug-in contact element in a sectioned illustration along the line F—F according to FIG. 3, FIG. 14 shows a cross section through the spring arm base of an inventive plug-in contact element along the line G—G according to FIG. 13.

The inventive plug-in contact element 1 (FIG. 1) has a basic contact 3 designed as a fork spring and a sleeve 50 formed like a box cantilever spring arranged around the basic contact 3.

The plug-in contact element 1 is designed for receiving a post-like plug-in contact pin having four sides including a first pair of sides, such as a north side and a south side arranged opposite each other, and a second pair of sides, such as an east side and a west side arranged opposite each other to provide a square cross section. Accordingly, only the north and south sides have a noble metal coating.

Along a longitudinal axis 2, the basic contact 3 has a rear connecting region 4, a central base region 5 adjacent to the rear connecting region 4, and a contact region 6, which are linked one behind another in one piece, the plug-in direction running from front to back. In cross section (FIG. 6, 7), the connecting region 4 is flat, round, shaped like a section of a circle and has a round bottom wall 7, a crimp tab 10 for an electric conductor being arranged on each upper edge 9 of the wall 7 at its free rear end region 8. The crimp tabs 10 are arranged offset from one another in relation to the longitudinal axis 2 by about half their width, so that one crimp tab 10 is fitted directly adjacent to the rear free end 8, and the other crimp tab 10 is offset a little to the front in relation to the longitudinal axis 2. In the further course of the basic contact to the front, one crimp tongue 11 each for conductor cores of an electric conductor is arranged at a distance from the front crimp tab 10, spaced from the latter by its width, on both upper edges 9 and at the same level in relation to the longitudinal axis. The crimp tongues 11 have a width which corresponds approximately to three times the width of the crimp tabs 10.

Between the front crimp tab 10 and the crimp tongues 11, the wall 7 has a course which narrows into a step-shaped portion 13 on the bottom side, in order to compensate for the lack of insulation around a conductor core to be clamped by the crimp tongues 11. The step-shaped portion may also be designed as an insulation displacement contact or a solder contact.

To the front in relation to the longitudinal axis 2, the rear connecting region 4 includes a transition piece 15 so that the base region 5 adjoins the rear connecting region 4, being connected to the rear connecting region 4 by the transition piece 15. In the region of the transition piece 15, the bottom wall 7 assumes a level course, side walls 17 extending upward adjoining the bottom wall 7 perpendicularly at its longitudinal edges 16, so that a U-shaped configuration which is open at the top and elongate in cross section is achieved. The side walls 17 broaden from the connecting region 4 to the base region 5, initially with a slope 19, in the rear portion of the base region 5 to form a step 22, at which the side wall 17 has approximately ⅔ its overall width. In the region of the step 22, the side walls 17 each have a rectangular cut-out 18, these being arranged opposite each other at one level.

In the further course to the front, the side walls 17 broaden and form guide tongues 20. A further cut-out 21 is made in the side walls 17, adjacent to the guide tongues 20 in the direction of the longitudinal extent to the front, located opposite the cut-outs 18 in the longitudinal direction.

Adjacent to the cut-outs 21, following to the front in the longitudinal extent, the base region 5 has a box shape defined by a (base) top wall 25, the above mentioned (base) side walls 17, and the above mentioned (base) bottom wall 7, the top wall 25 being arranged opposite the bottom wall 7 and running parallel to the latter.

In the region of the box-like base region 5, at the transverse center, a narrow tongue 23 with a U-shaped section is cut free of the bottom wall 7 and pressed outward, a free cross section 24 of the tongue 23 pointing to the rear.

The top wall 25 is linked to one of the side walls 17 along an upper side edge 26 of the latter. The top wall 25 extends toward the opposite inner side 27 of the other side wall 17 and, in the region of the upper longitudinal edge 28 of the side wall 17, terminates flush with the outside 29 of the latter. The bottom wall 7, the side walls 17 and the top wall 25 form front edges 31, 32, 33, 34 which point forward at one level, and with which the base region 5 terminates toward the front.

A short tongue 35 adjoins each of the front edges 32 of the side walls 17 centrally, extending forward a short way and having a width which is approximately half the size of that of the side walls 17.

A contact spring arm 37, 38 is in each case attached to the front edges 31, 34 of the bottom wall 7 and the top wall 25.

It is noted, as indicated in FIG. 1, that the upper contact spring arm 38 is considered to be the north contact spring arm, and the lower contact spring arm 37 is considered to be the south contact spring arm.

The contact spring arms 37, 38 have a width which is preferably somewhat less than the width of the bottom wall 7 and the top wall 25. The contact spring arms 37, 38 extend forward, tapering toward each other as far as a contact-point region or a contact line 40 and their free ends 41, 42 being bent outward away from the contact point or from the contact line 40 and forming a locating funnel 45.

The contact line 40 is displaced upward toward the top wall 25, so as to deviate from the transverse center of the base region 5, so that the lower contact spring arm 37 is bent more sharply inward than the upper contact spring arm 38.

Adjacent to the region where the contact spring arms 37, 38 are attached to the bottom wall 7 and top wall 25, the contact spring arms 37, 38 have tabs 44 on their longitudinal edges 39 which are shaped like portions of a circle and point and project outward.

The box cantilever spring shaped sleeve 50 is arranged around the base region 5 and the contact region 6 of the basic contact 3, which is configured in this way as a fork or flat spring.

The box cantilever spring shaped sleeve 50 is designed to be elongate box-shaped or rectangular with an essentially square cross section, a front plug-in opening 51 and a rear opening 52. The box cantilever spring shaped sleeve 50 has a sleeve bottom wall 53, two sleeve side walls 54, 55 and a sleeve top wall 56, as well as four longitudinal sleeve edges 57.

From the longitudinal center in the direction of the plug-in opening 51, the sleeve bottom wall 53 has a U-shaped cut 59, which reaches beyond the longitudinal sleeve edges 57 at the sides. By this means, a cantilever spring arm 60, which extends in the direction of the plug-in opening 51, is cut free.

An approximately square cut-out 61 is made longitudinally centrally in the sleeve bottom wall 53, in the plug-in direction behind the cantilever spring arm 60, toward the opening 52, said cut-out being half as wide as the sleeve bottom wall 53. The transverse edge 24 of a rear free end of the latching tongue 23 that projects out of the bottom wall 7 rests on the rear transverse edge of the cut-out 61, and locks the box cantilever spring shaped sleeve 50 against sliding forward.

Tongues 62 are cut free of the sleeve side walls 54, 55, behind the plug-in opening 51 in the plug-in direction, adjacent to this opening and transversely centrally, and are bent inward toward the contact-point region 40. The contact spring arms 37, 38, in the region of their closest approach, rest with prestress on the inwardly bent tongues 62, which are somewhat narrower than a plug-in pin to be inserted. By this means, the contact spring arms are widened in advance, which permits a reduction in the plug-in force. Furthermore, the tongues serve as a lateral guide for a plug-in contact pin.

The plug-in opening 51 has a square cross section of smaller diameter than the box cantilever spring shaped sleeve 50. In order to form the plug-in opening 51, wall sections 63 which taper obliquely toward one another are arranged toward the front, as a result of which the sleeve bottom, sleeve side and sleeve top walls 53, 54, 55, 56 converge toward the plug-in opening 51. The forward-pointing free ends of the wall sections 63 are bent slightly outward counter to the plug-in direction, so that a prelocating funnel 65 is formed. As viewed in the plug-in direction, the oblique wall sections 63 cover the free ends 41, 42 of the contact spring arms 37, 38, so that plugging-in wrongly is avoided.

In the region of the rear opening 52, tongues 66, 67 are cut free of the sleeve side walls 54, 55, are essentially as wide as the cut-out 18 and, along the side walls 17, are bent through 180° around the lower edge of the cut-outs 18, so that they rest with free ends 68 on the inner sides of the sleeve side walls 17 and thus hold the box cantilever spring shaped sleeve 50 on the basic contact element 3 in a clamping fashion.

The sleeve top wall 56 is attached to the sleeve side wall 54 that is to the right in the plug-in direction (FIG. 10) along the longitudinal sleeve edge 57 and extends toward the opposite side sleeve wall 55, parallel to the sleeve bottom wall 53.

A polarization plate 70 is attached to the sleeve top wall 56, along the longitudinal sleeve edge 57, at the level of the sleeve side wall 55 and in upward extension of the latter.

The polarization plate 70 has a width which corresponds approximately to ¼ to ⅓ the width of the sleeve side walls 54, 55.

A latching spring arm 72, which points rearward, broadens a little to the rear and is bent upward, is cut free of the sleeve top wall 56 by way of a U-shaped cut 71 (FIG. 4; FIG. 10), the cut 71 extending over the common longitudinal sleeve edge 57 of the sleeve top wall 56 and of the sleeve side wall 55 and, on the opposite side, extending upward a little over the common longitudinal sleeve edge 57 with the polarization plate 70, the latching spring arm 72 preferably terminating with the upper edge of the polarization plate 70 or projecting beyond the latter.

The latching spring arm 72 has a V-shaped outwardly embossed section 81, whose open side points to its free, rearwardly pointing end 82. The latching spring arm 72 has a downwardly pointing embossed section 84 on a rear, free transverse edge 83 of the free end 82.

A spring arm attachment tab 73 is bent out of the sleeve side wall 54 at right angles and extends toward the sleeve side wall 55, a rear transverse edge 74 of the spring arm attachment tab 73 being arranged slightly below a transverse edge of the top sleeve wall 56 which bounds the cut 71 to the rear, and being firmly connected to said sleeve top wall 56 by means of a spot weld 75.

A front transverse edge of the web 73 has attached to it, at the level of the cantilever spring arm 60, a cantilever spring arm 77, which points forward in the same way.

The cantilever spring arms 60, 77 rest by way of free ends 78, 79 on the contact spring arms 37, 38, the cantilever spring arm 77 being bent inward less sharply than the cantilever spring arm 60.

The cantilever spring arm 77 has, at its free end 78 pointing toward the contact spring arm 38, a chamfer 80 (FIG. 12), with which it rests on the contact spring arm 38. The cantilever spring arms 60, 77 rest on the contact spring arms 37, 38 approximately at the center of the longitudinal extent.

Adjacent to a tongue 62 of the side wall 55, a tongue 85 of the top wall 56, which tongue extends beyond the side wall 55, rests on the side wall 55 and is connected to the latter by means of a spot weld 86.

In the case of an inventive plug-in contact element of this type, it is advantageous that the contact spring arms, the cantilever spring arms, the latching spring arm and the polarization plate are arranged on the north/south sides or are oriented in the north/south direction, so that the plug-in contact element, which has no projecting elements on the east/west sides, but only side walls, can be of very narrow design.

By this means, still closer plug-in patterns could be achieved. The fact that the contact spring arms rest only on the noble-metal coated north/south faces of a plug-in contact pin achieves improved contact, this being further improved to a large extent by the cantilever spring arms, which load the contact spring arms.

The inventive configuration in design terms provides for the first time to arrange a contact spring arm, a cantilever spring arm and a latching spring arm on one (north/south) side of the plug-in contact element, without this plug-in contact element losing any strength.

What is claimed is:

1. A plug-in contact element fabricated from a sheet metal stamping for receiving a post-like plug-in contact pin having four sides including a first pair of sides arranged opposite each other, and a second pair of sides arranged opposite each other to provide a square cross section, said plug-in contact element (1) comprising:

a basic contact element (3) provided with a rear connecting region (4), a central base region (5) and a front contact region (6) linked together one behind another in a one piece construction along a longitudinal axis (2), said basic contact element (3) being constructed as a flat spring element;

said base region (5) having a base bottom wall (7), two base side walls (17) and a base top wall (25) to provide a box shaped configuration;

said front contact region (6) including contact spring arms (38, 37) connected to said base top and base bottom walls (25, 7) respectively, said contact spring arms (38, 37) extending forward from said base top and base bottom walls (25, 7), inner flat sides of said contact spring arms (38, 37) being disposed opposite each other for contacting the first pair of sides of the plug-in contact pin;

sleeve means for protecting said contact spring arms (38, 37), said sleeve means including a rectangular sleeve (50) having a sleeve bottom wall (53), sleeve side walls (54, 55) and a sleeve top wall (56) arranged around said base region (5) and said contact region (6) so that said contact spring arms (38, 37) are protectively disposed within said sleeve (50);

a polarization plate (70) extending outwardly from said sleeve top wall (56) for polarization of said basic contact element (3);

a latching spring arm (72) projecting outwardly from said sleeve top wall (56) for latching said basic contact element (3);

said base bottom wall (7) and said sleeve bottom wall (53) on one side, and said base top wall (25) and said sleeve top wall (56) on an opposite side being arranged to receive the first pair of sides of the plug-in contact pin therebetween;

spring means for providing a contact force between said contact spring arms (37, 38) and the plug-in contact pin, said spring means including said sleeve (50) being constructed as a box cantilever spring having first and second cantilever spring arms (60, 77) disposed in loading contact with outer surfaces of said contact spring arms (37, 38), said first cantilever spring arm (60) being cut free of said sleeve bottom wall (53), said second cantilever spring arm (77) being attached to an additional spring arm attachment tab (73) disposed under said sleeve top wall (56), said latching spring arm (72) being disposed above said second cantilever spring arm (77); and said first and second cantilever spring arms (60, 77) extending forward in a longitudinal direction of said plug-in contact element (1) toward a plug-in opening (51) of said sleeve (50).

2. A plug-in contact element according to claim 1, wherein said base bottom wall (7) at a rear portion of said base region (5) is flat, longitudinal edges (16) of said bottom wall (7) are linked to said base side walls (17) so that said base side walls (17) extend perpendicularly upward, said rear portion of said base region (5) having an open top to provide a U-shaped cross section, a forward portion of said base region (5) being provided with said base top wall (25) opposite said base bottom wall (7), said base top wall (25) running parallel to said base bottom wall (7) to provide said box shaped configuration.

3. A plug-in contact element according to claim 1, wherein said contact spring arms (37, 38) are connected to front edges (31, 34) of said base bottom and base top walls (7, 25) respectively.

4. A plug-in contact element according to claim 1, wherein an upper side edge (26) of one of said base side walls (17) is connected to said base top wall, said base top wall (25) extending toward an inner side (27) of an opposite one of said base side walls (17), and terminating flush with an outside (29) of said opposite one of base said side walls (17) in a region of an upper longitudinal edge (28) of said opposite one of said base side walls (17).

5. A plug-in contact element according to claim 1, wherein forward extending short tongues (35) are centrally provided on front edges (32) of said base side walls (17), said short tongues (35) being approximately half a size of said base side walls (17).

6. A plug-in contact element according to claim 1, wherein said contact spring arms (37, 38) have a width less than a width of said base bottom and base top walls (7, 25), said contact spring arms (37, 38) tapering toward each other as said contact spring arms (37, 38) extend forward to a transverse contact line (40), free ends (41, 42) of said contact spring arms (37, 38) being bent sharply in an outward direction away from said contact line (40) to provide a locating funnel (45).

7. A plug-in contact element according to claim 6, wherein said contact line (40) is disposed in a region of a transverse center of said base region (5) so that said contact spring arms (37, 38) are bent inward equally sharply.

8. A plug-in contact element according to claim 6, wherein said contact line (40) is displaced upward toward said base top wall (25) to deviate from a transverse center of said base region (5) so that a lower one (37) of said contact spring arms, which is connected to said base bottom wall (7), is bent more sharply inward than an upper one (38) of said contact spring arms, which is connected to said base top wall (25).

9. A plug-in contact element according to claim 3, wherein longitudinal edges (39) of said contact spring arms (37, 38) have tabs (44) thereon in a portion adjacent to a region of connection between said contact spring arms (37, 38) and said front edges (31, 34), said tabs (44) being shaped like portions of a circle, said tabs (44) pointing and projecting outward from said longitudinal edges (39).

10. A plug-in contact element according to claim 1, wherein a U-shaped narrow tongue (23) is cut free of and extends outward from said base bottom wall (7) approximately at a transverse center thereof in a region of said rectangular sleeve (50), so that a free transverse edge (24) of said tongue (23) points rearward toward said rear connecting region (4).

11. A plug-in contact element according to claim 1, wherein said base side walls (17) broaden when said rear connecting region (4) extends into said central base region (5), and each base side wall (17) includes a slope (19) to provide a step (22) having a height approximately ⅔ of said rectangular sleeve (50), a rectangular cut-out (18) being provided in each step (22) at one level opposite each other.

12. A plug-in contact element according to claim 11, wherein a further cut-out (21) is provided in each of said base side walls (17) forward of said rectangular cut-outs (18), each of said base side walls (17) having a guide tongue (20) disposed between said rectangular cut-out (18) and said further cut-out (21).

13. A plug-in contact element according to claim 1, wherein said sleeve (50) has four longitudinal sleeve edges (57) to provide a square cross section and a rear opening (52), said sleeve (50) being provided with a spring-arm attachment tab (73).

14. A plug-in contact element according to claim 13, wherein a U-shaped cut (59) is provided in said sleeve bottom wall (53), said U-shaped cut (59) extending from a longitudinal center thereof toward said plug-in opening (51) and also extending laterally beyond said longitudinal sleeve edges (57) in order to cut free said first cantilever spring arm (60).

15. A plug-in contact element according to claim 10, wherein an approximately square cut-out (61) is provided in said sleeve bottom wall (53), said square cut-out (61) extending from a longitudinal center thereof rearward of said first cantilever spring arm (60) toward a rear opening (52) of said sleeve (50), said square cut-out (61) being approximately half as wide as said sleeve bottom wall (53), said free transverse edge (24) of said tongue (23) rests on a rear transverse edge of said square cut-out (61) so that said sleeve (50) is locked against sliding forward on said basic contact element (3).

16. A plug-in contact element according to claim 1, wherein tongues (62) are cut free of said sleeve side walls (54, 55) from a transverse center thereof rearward of said plug-in opening (51), said tongues (62) being bent inward toward a transverse contact line (40) of said contact spring arms (37, 38) so that said contact spring arms (37, 38), in a prestressed condition, rest on said tongues (62), a width of said tongues (62) being approximately ⅕ of a width of said sleeve side walls (54, 55).

17. A plug-in contact element according to claim 1, wherein said sleeve bottom, sleeve side and sleeve top walls (53, 54, 55, 56) include wall sections (63) which taper obliquely forward toward each other to converge toward said plug-in opening (51) so that said plug-in opening (51) has a square cross section of smaller size than said sleeve (50).

18. A plug-in contact element according to claim 17, wherein forward-pointing free ends of said wall sections (63) are bent slightly outward counter to plug-in direction to provide a prelocating funnel (65), said wall sections (63) covering free ends (41, 42) of said contact spring arms (37, 38) as viewed in said plug-in direction for protection thereof.

19. A plug-in contact element according to claim 11, wherein tongues (66,67) are cut free from said sleeve side walls (54, 55) in a region of a rear opening (52) of said sleeve (50), said tongues (66, 67) being approximately as wide as said cut-outs (18) with said tongues (66, 67) being bent through 180 degrees around lower edges of said cut-outs (18) so that free ends (68) of said tongues (66, 67) rest on inner sides of said base side walls (17) to hold said sleeve (50) on said basic contact element (3) in a clamping arrangement.

20. A plug-in contact element according to claim 1, wherein a longitudinal sleeve edge (57) attaches said sleeve top wall (56) to one (54) of said sleeve side walls so that said sleeve top wall (56) extends parallel to said sleeve bottom wall (53) toward an opposite one (55) of said sleeve side walls.

21. A plug-in contact element according to claim 20, wherein said polarization plate (70) is attached to said sleeve top wall (56) as an upper extension of said opposite one (55) of said sleeve side walls.

22. A plug-in contact element according to claim 21, wherein a width of said polarization plate (70) is ⅓ of a width of said sleeve side walls (54, 55).

23. A plug-in contact element according to claim 21, wherein said latching spring arm (72) is cut free of said sleeve top wall (56) by a U-shaped cut (71) so that said latching spring arm (72) points rearward, said latching spring arm (72) broadens a little when extending rearward, and bends upward from said sleeve top wall (56), said U-shaped cut (71) extending over said longitudinal sleeve edge (57) between said sleeve top wall (56) and said one (54) of said sleeve side walls, said U-shaped cut (71) extending upward a little on an opposite side beyond a common longitudinal edge between said sleeve top wall (56) and said polarization plate (70).

24. A plug-in contact element according to claim 23, wherein a V-shaped outwardly embossed section (81) is provided on said latching spring arm (72) so that an open side of said embossed section (81) points to a free, rearwardly pointing end (82) of said latching spring arm (72), a downwardly pointing embossed section (84) being provided on a rear, free transverse edge (83) of said rearwardly pointing end (82) of said latching spring arm (72).

25. A plug-in contact element according to claim 23, wherein a spring-arm attachment tab (73) extends from said one (54) of said sleeve side walls toward said opposite one (55) of said sleeve side walls so that a rear transverse edge (74) of said spring-arm attachment tab (73) is arranged slightly below a transverse edge of said sleeve top wall (56) in order for said spring-arm attachment tab (73) to bound a rear part of said U-shaped cut (71) in said sleeve top wall (56), a spot weld firmly connecting said spring-arm attachment tab (73) to said sleeve top wall (56).

26. A plug-in contact element according to claim 25, wherein said second cantilever spring arm (77) is attached to a front transverse edge of said spring-arm attachment tab (73) at same level as said first cantilever spring arm (60) so that said first and second cantilever spring arms (60, 77) point forward in same manner.

27. A plug-in contact element according to claim 26, wherein first and second free ends (79, 78) of said first and second cantilever spring arms (60, 77), respectively, rest on said contact spring arms (37, 38).

28. A plug-in contact element according to claim 27, wherein a chamfer (80) is provided on said second free end (78) of said second cantilever spring arm (77) which points toward one (38) of said contact spring arms, so that said chamfer (80) rests on said one (38) of said contact spring arms.

29. A plug-in contact element according to claim 26, wherein said first and second cantilever spring arms (60, 77) rest approximately at a center of a longitudinal extent of said contact spring arms (37, 38), respectively.

30. A plug-in contact element according to claim 1, wherein a first tongue (85) of said sleeve top wall (56) rests on one (55) of said sleeve side walls adjacent to a second tongue (62) of said one (55) of said sleeve side walls, said first tongue (85) extending beyond said one (55) of said sleeve side walls and being connected to said one (55) of said sleeve side walls by a spot weld (86).

* * * * *